US005400935A

United States Patent [19]

Farmer

[11] Patent Number: 5,400,935

[45] Date of Patent: Mar. 28, 1995

[54] HARNESS AND HOLSTER ASSEMBLY

[76] Inventor: Bert A. Farmer, 631 E. Northview, Phoenix, Ariz. 85020

[21] Appl. No.: 234,049

[22] Filed: Apr. 28, 1994

[51] Int. Cl.[6] ..... F41C 33/02

[52] U.S. Cl. ..... 224/208; 224/198; 224/205; 224/206; 224/911

[58] Field of Search ..... 224/192, 193, 202, 205, 224/206, 208, 257, 258, 911, 912, 198

[56] References Cited

U.S. PATENT DOCUMENTS

| | | | |
|---|---|---|---|
| 834,419 | 10/1906 | Stewart | 224/206 |
| 1,302,312 | 4/1919 | Cook | 224/208 X |
| 1,601,963 | 10/1926 | Arth | 224/206 X |
| 2,109,232 | 2/1938 | Hoyt | 224/208 X |
| 2,146,570 | 2/1939 | Gordon | 224/206 |
| 2,396,118 | 3/1946 | Ohlemeyer | 224/911 X |
| 3,797,715 | 3/1974 | Scialdone | 224/206 |
| 4,991,758 | 2/1991 | Eaneff | 224/208 |

*Primary Examiner*—J. Casimer Jacyna
*Attorney, Agent, or Firm*—Harry M. Weiss

[57] ABSTRACT

A handgun harness assembly and holster assembly for carrying large frame, high powered handguns. The harness assembly comprises a three strap harness having a shoulder strap, an armpit strap, and a two section trunk strap. A handgun holster is connected to the two section trunk strap and positioned against the body of the wearer. The shoulder strap is positioned across the shoulder opposite the shoulder closest to the handgun holster and extends from a breast region of the user to a shoulder blade region of the user. Joined to the ends of the shoulder strap by swivel connection means is an armpit strap which is placed under the arm that the shoulder strap is placed over. The two section trunk strap is connected to the holster assembly at one end and is coupled to the swivel connection means at the other end.

3 Claims, 3 Drawing Sheets

HARNESS AND HOLSTER ASSEMBLY

TECHNICAL FIELD

This invention is concerned with providing a hunter with a convenient assembly for carrying a high-powered handgun.

BACKGROUND ART

Shoulder harnesses for handguns have been around for many years. These have customarily been worn by persons who wished to conceal the presence of the weapon. The approach generally used has been to provide a shoulder harness with the pistol holster positioned beneath the armpit of the wearer. Examples of harnesses of this type are disclosed in U.S. patents U.S. Pat. No. 834,416, granted Oct. 30, 1906, to B. F. Stewart for "REVOLVER—BELT AND SUSPENDERS" and U.S. Pat. No. 3,797,715, granted Mar. 19, 1974, to S. R. Scialdone for "NOVEL HOLSTER AND HARNESS".

The armpit holster harness is simply not practical for the high-powered handguns used by hunters stalking game. These guns are too large and too heavy to be carried comfortably beneath the armpit.

Harnesses have, of course, been devised for carrying bulky and heavy objects. For example, U.S. Pat. No. 2,146,570, granted Feb. 7, 1939, for "BODY CARRIER FOR BATTERY HEARING AID" discloses a shoulder and chest harness for supporting the several components of an early model, bulky hearing aid. And, the more recent patent U.S. Pat. No. 4,991,758, granted Feb. 12, 1991, to C. S. Eaneff for "SUPPORT SYSTEM FOR PORTABLE VIDEO CAMERA" discloses a harness arrangement for supporting the weight of a heavy camera on both shoulders of a person. Neither of these harnesses particularly lend themselves to carrying a high-powered handgun.

DISCLOSURE OF THE INVENTION

This invention provides an across-the-chest positioning of the gun holster so the gun is conveniently accessible to the wearer, but out of the way of arm movements. The holster is stabilized in position and the weight of the gun transferred to the wearer by a three-strap harness. A shoulder strap extends from a breast region to a shoulder blade region across the shoulder opposite the shoulder closest to the holster. Joined to the ends of the shoulder strap by means of a swivel connection is an armpit strap under the arm next to the shoulder strap. A trunk strap, preferably formed in anterior and posterior sections, carriers the holster and has its ends joined to the two swivel connections. The holster can be further stabilized with a slidable connection at its lower end cooperating with a waist belt of the wearer.

BRIEF DESCRIPTION OF THE DRAWINGS

The invention is disclosed in greater detail hereinafter by reference to the accompanying drawings, wherein.

BEST MODE FOR CARRYING OUT THE INVENTION

Figure 3:
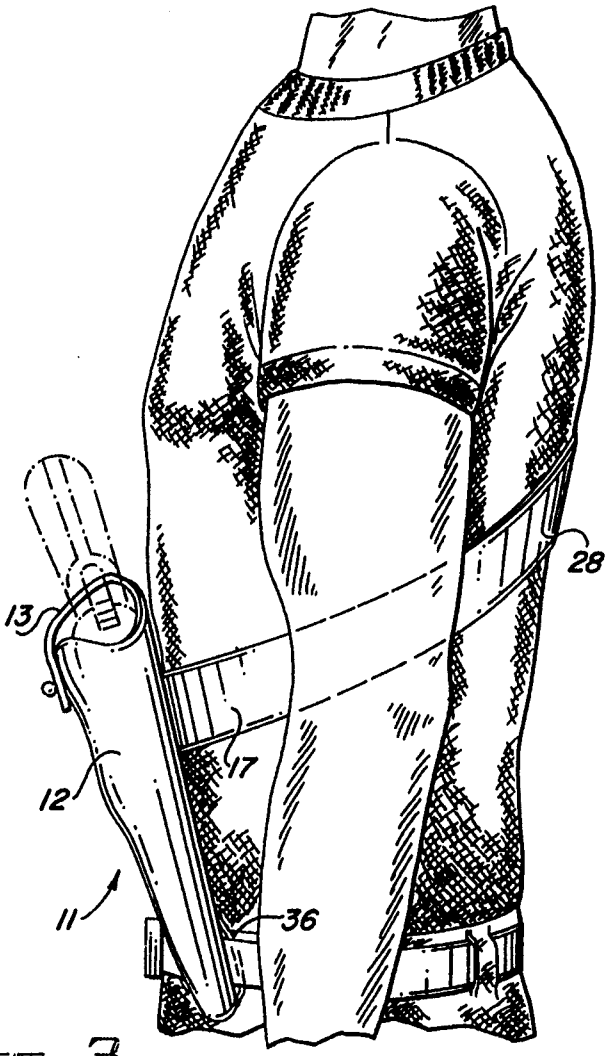
FIG. 3 is a left side view of the same.
Figure 1:
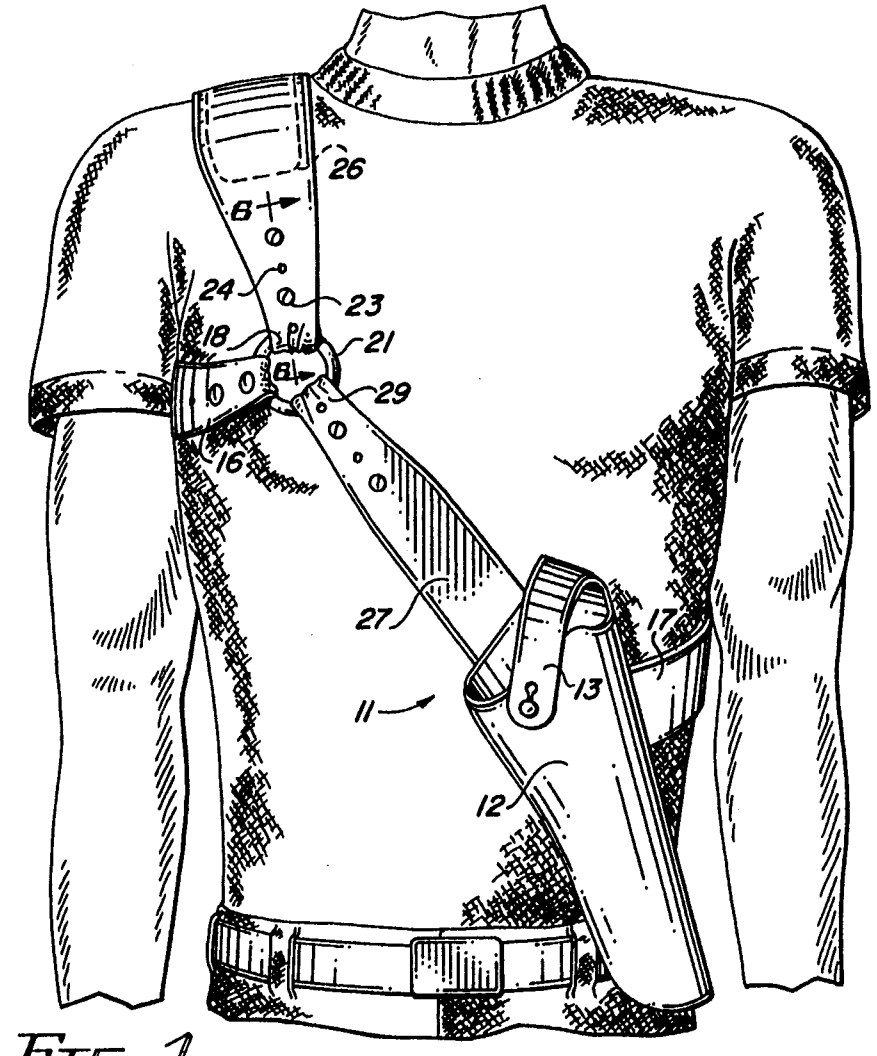
FIG. 1 is a front view of the torso of a person wearing the harness and holster assembly of this invention.
Figure 2:
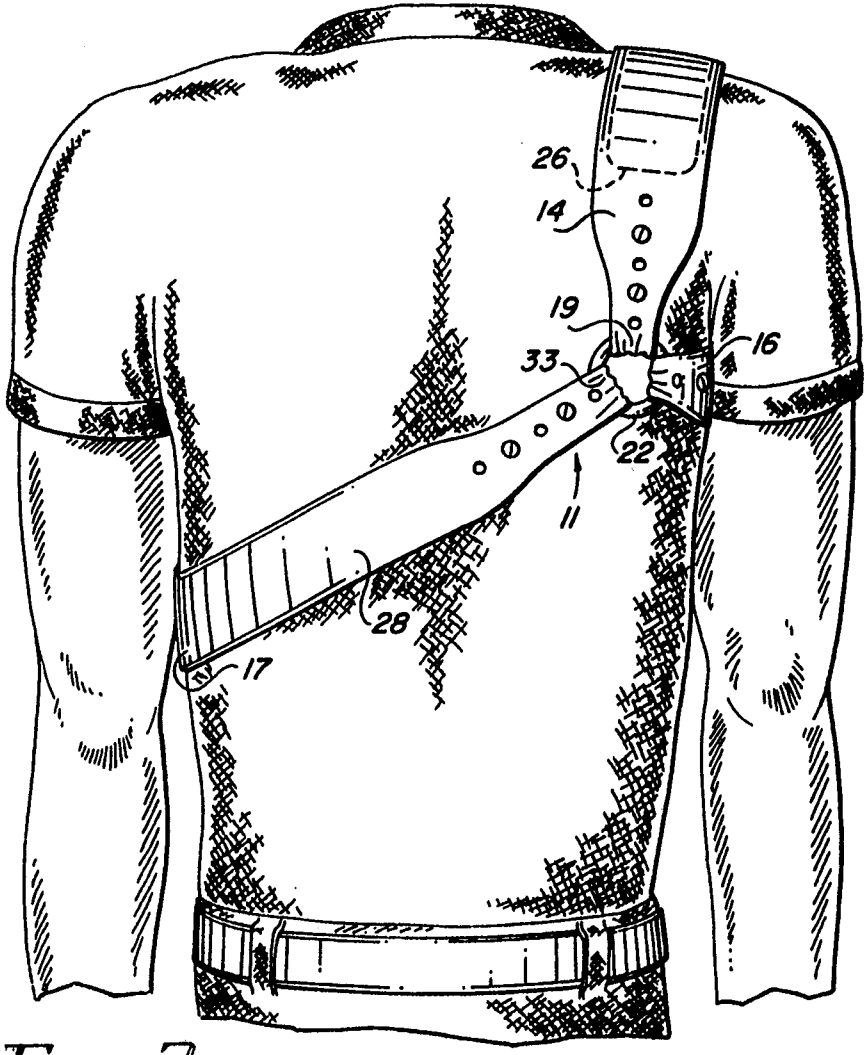
FIG. 2 is a rear view of the same.
Figure 4:
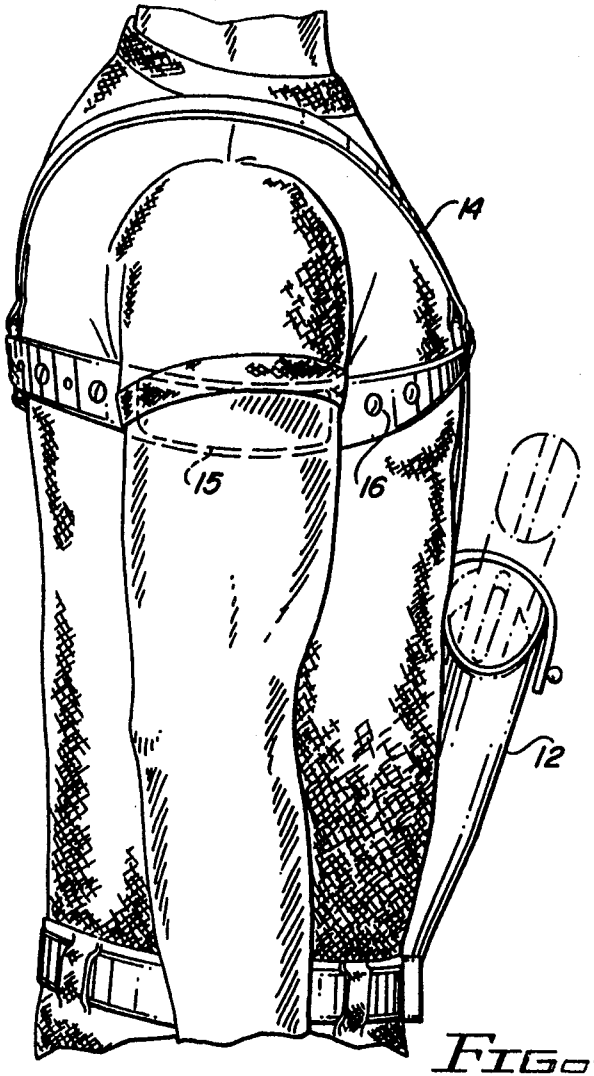
FIG. 4 is a right side view of the same.

Referring particularly to. FIGS. 1–4, the harness and holster assembly there depicted and designated generally by reference numeral 11, is adapted to position a high-powered handgun at the chest and generally beneath a breast of the wearer. The assembly shown is that worn by a right-handed person with the holster 12 positioned beneath the left breast. For a left-handed person, the entire assembly would be reversed.

The holster is of conventional construction, being made from leather or other wear-resistant flexible material. The holster is shaped and sized to the particular weapon to be carried and may be provided with a retention strap 13. In addition, the holster 12 is preferably canted at an angle of approximately 15° to 20° to the vertical. This disposition points the weapon away from the body of the wearer for safety purposes and also facilitates grasping and removing the weapon by its handle.

This holster 12 is positioned and supported by a three-strap shoulder harness comprising a shoulder strap 14, an armpit strap 16, and a two-section trunk strap 17. All of the straps are preferably made from leather or other strong flexible material.

Figure 6:
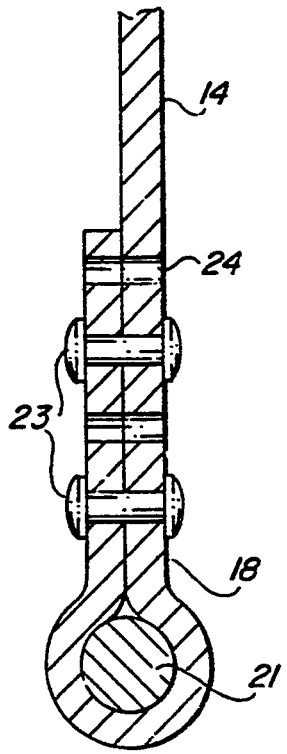
FIG. 6 is a fragmentary sectional view through a strap connection taken generally as indicated by line 6—6 in FIG. 1.

Shoulder strap 14 is adapted to overly the shoulder opposite the location of the holster 12. The shoulder strap extends from a region in the vicinity of and slightly above the breast of the wearer (see FIG. 1) to the region of the shoulder blade of the wearer (see FIG. 2). The shoulder strap 14 has its anterior end 18 attached to a swivel connection such as a metal ring 21. The posterior end 19 of the shoulder strap is attached to another swivel connection such as metal ring 22. Attachment of shoulder strap 14 to the rings 21 and 22 is preferably achieved by threading the ends of the strap through the ring and folding these ends back on themselves. Attachment is secured by placing threaded posts 23 through openings in the two layers of straps (see FIG. 6). By providing a series of openings 24 in the ends of the strap, its length can be adjusted. If desired, comfort of the shoulder strap can be enhanced by providing a soft pad 26 on the underside of that portion of the strap going over the shoulder.

Armpit strap 16 is just that, it extends beneath the armpit at the shoulder strap shoulder. Armpit strap 16 has its respective anterior and posterior ends attached respectively to swivel rings 21 and 22 in the same manner as shoulder strap 14 is attached to these rings and also preferably has similar provisions for length adjustment.

If desired, additional comfort for the wearer can be provided by lining the inner surfaces of the armpit strap 16 with a soft pad 15 or this section of the strap can be elasticized.

As mentioned previously, trunk strap 17 is preferably made in two sections, an anterior section 27 and a posterior section 28. Anterior section 27 of the trunk strap has one end 29 attached to swivel ring 21 in the same manner as straps 14 and 16 are attached. The other end 31 of strap section 27 is affixed to the holster, preferably by stitching 32 (see FIG. 5). Posterior section 28 has one end 33 attached to swivel ring 22 in the same manner as straps 14 and 16. The other, or forward, end 34 of strap section 28 is affixed to the holster, also preferably by stitching 35.

Figure 5:
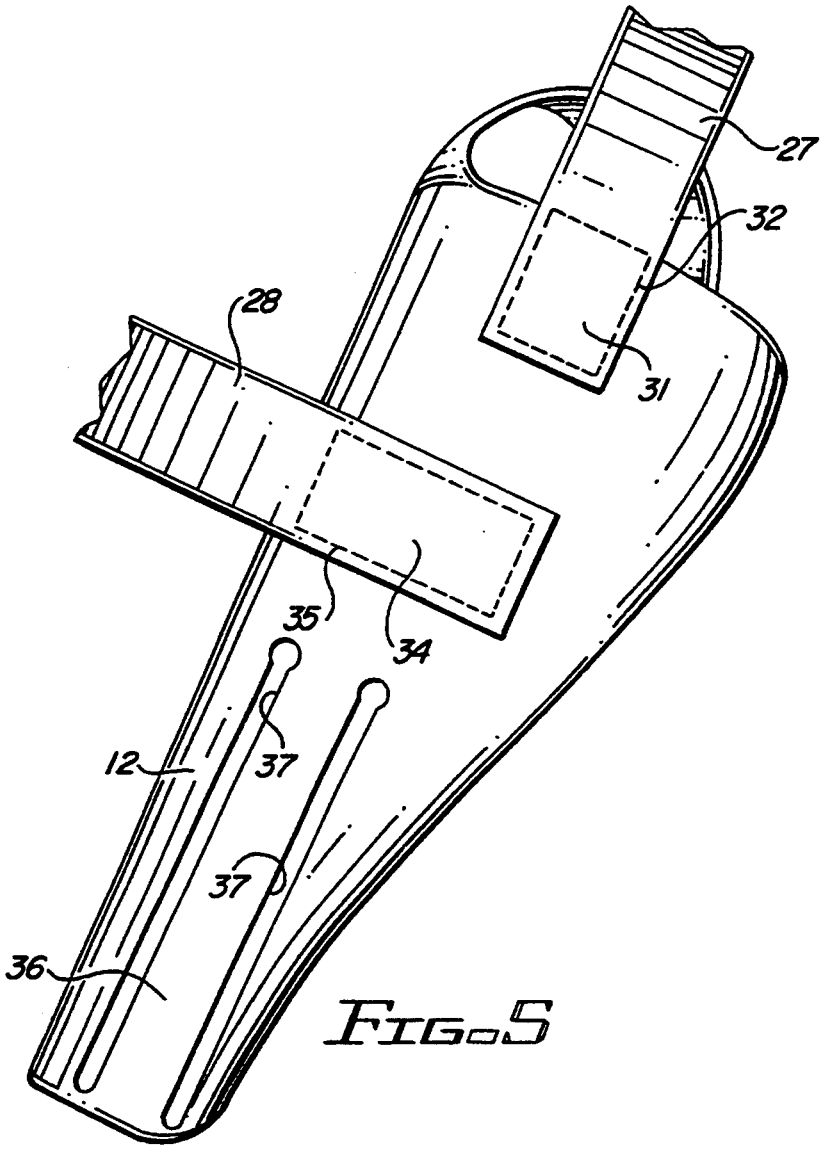
FIG. 5 is a fragmentary view of the back of the holster.

As shown in FIG. 5, the orientation of strap ends 31 and 34 with respect to the holster 12 is such that the strap sections 27 and 28 lead away from the holster 12 flush against the chest of the wearer. With the straps 14, 16 and 17 adjusted to snugly fit the chest and shoulder regions of the wearer, the holster 12 is held snugly against the chest of the wearer and positioned at the desired angle to the vertical with no tendency to flop around when the wearer moves.

The positioning of the holster 12 can be further stabilized by providing a slide loop connector 36 along the lower back of the holster through which the waist belt of the wearer can be inserted. The slide loop 36 can be formed by creating elongated slots 37 in the back wall of the holster. This allows the holster to slide up and down over the waist belt of the wearer as he bends at the waist. This gives the wearer complete freedom of movement with the assembly in place.

From the foregoing, it should be apparent that the harness and holster assembly 11 of this invention provides a stable, reliable and comfortable support for a large, high-powered handgun. With the gun positioned across the chest, the wearer has maximum freedom of movement with easy access to the gun. Freedom of movement can be particularly important to a hunter who carries a second gun, such as a rifle. The harness and holster assembly of this invention permits that hunter sufficient freedom of movement to handle, aim and fire the rifle with the handgun holstered.

What is claimed is:

1. A handgun harness assembly and holster assembly for supporting a large frame, high powered handgun on a human torso of a person comprising, in combination:

a shoulder strap for location on one shoulder of a person furthest from location of the holster assembly on a hip of the person and having a first end and a second end, said first end extending over one shoulder of the person to a shoulder blade region on the back of the person, said second end extending down from said shoulder to a breast region of the person;

first swivel connector means located on the back of the person and coupled to said first end of said shoulder strap for attaching said first end of said shoulder strap to said harness assembly;

second swivel connector means coupled to said second end of said shoulder strap for attaching said second end of said shoulder strap to said harness assembly;

an armpit strap having a first end coupled to said first swivel connector means and a second end extending under said one shoulder to said breast region and coupled to said second swivel connector means;

a trunk strap comprising:

an anterior strap section having a first end coupled to said second swivel connector means and a second end extending downwardly from said second swivel connector means across a chest region of the wearer; and a posterior strap section having a first end coupled to said first swivel connector means and a second end portion extending downwardly from said first swivel connector means and around a waist area opposite said one shoulder; and said holster assembly comprising a handgun holster having a back upper portion which is attached to said second end portion of said posterior strap section of said trunk strap, said holster assembly having a top portion which is coupled to said second end of said anterior strap section of said trunk strap, said holster assembly being attached to said second end of said posterior strap section and coupled to said second end of said anterior strap portion of said trunk strap to allow said holster assembly to be positioned to have a lower portion of said holster pointing away from the person's body, said holster assembly having an opening portion for a handgun positioned beneath an opposite breast region of said person and held against the body of said person so as to allow for free movement of both of said person's arms.

2. A handgun harness assembly and holster assembly in accordance with claim 1 further comprising a belt encircling said waist of said user and sliding connecting means attached to said holster assembly for slidably connecting said holster to said belt.

3. A handgun harness and holster assembly in accordance with claim 1 further comprising adjustment means located on said shoulder strap, said armpit strap, said anterior strap section of said trunk strap, and said posterior strap section of said trunk strap for adjusting the length of the respective straps.

* * * * *